US008657072B2

(12) United States Patent
Caple

(10) Patent No.: US 8,657,072 B2
(45) Date of Patent: Feb. 25, 2014

(54) SAWHORSE WITH CUTTING SUPPORT PLATFORM

(75) Inventor: Kurtis Banks Caple, West Chester, OH (US)

(73) Assignee: Kurt Caple, West Chester, OH (US)

( * ) Notice: Subject to any disclaimer, the term of this patent is extended or adjusted under 35 U.S.C. 154(b) by 113 days.

(21) Appl. No.: 12/928,924

(22) Filed: Dec. 23, 2010

(65) Prior Publication Data

US 2011/0155506 A1 Jun. 30, 2011

Related U.S. Application Data

(60) Provisional application No. 61/284,849, filed on Dec. 28, 2009.

(51) Int. Cl.
*B25H 1/06* (2006.01)

(52) U.S. Cl.
CPC ..... *B25H 1/06* (2013.01)
USPC ..... 182/186.9; 182/152; 182/153; 182/181.1; 182/183.1; 182/186.5

(58) Field of Classification Search
USPC ..... 182/152, 153, 181.1, 183.1, 185.1, 182/186.3, 186.5, 186.7, 186.9
See application file for complete search history.

(56) References Cited

U.S. PATENT DOCUMENTS

| | | | | | |
|---|---|---|---|---|---|
| 472,867 | A * | 4/1892 | Farland | 248/237 |
| 829,312 | A * | 8/1906 | Alberty | 248/237 |
| 1,222,053 | A * | 4/1917 | Watson | 248/237 |
| 1,452,717 | A * | 4/1923 | Wertz | 182/20 |
| 1,742,637 | A * | 1/1930 | Dearborn | 182/153 |
| 2,560,821 | A * | 7/1951 | Gray et al. | 108/78 |
| 2,594,262 | A * | 4/1952 | Howe | 108/81 |
| 2,886,386 | A * | 5/1959 | Spitzer | 108/135 |
| 3,530,956 | A * | 9/1970 | Jadek | 182/186.2 |
| 3,866,715 | A * | 2/1975 | Foulk | 182/45 |
| 4,113,056 | A * | 9/1978 | DeLorenzo | 182/153 |
| 4,688,541 | A * | 8/1987 | Stephen et al. | 126/25 R |
| 5,016,607 | A * | 5/1991 | Doolittle et al. | 126/25 R |
| 5,297,655 | A * | 3/1994 | Wolfe | 182/153 |
| 5,351,785 | A * | 10/1994 | DuRapau | 182/153 |
| 5,402,860 | A * | 4/1995 | Fry | 182/225 |
| 5,427,200 | A * | 6/1995 | Yemini | 182/153 |
| 5,628,382 | A * | 5/1997 | Hill | 182/153 |

(Continued)

*Primary Examiner* — Katherine Mitchell
*Assistant Examiner* — Colleen M Chavchavadze
(74) *Attorney, Agent, or Firm* — Schwegman, Lundberg & Woessner, P.A.

(57) ABSTRACT

The design is for a sawhorse with a collapsible support platform to support material that is being cut-off or worked on. The support platform keeps the material that is being cut from falling and/or splintering at the end of the cut and reduces or eliminates the need for an addition person to support the portion of the material being cut-off or for the person doing the cutting to attempt to hold the material being cut-off with one hand while cutting with the other and creating an unsafe condition. The sawhorse with support platform does not necessarily eliminate the need for a second sawhorse to support the opposite end of the material being cut or worked on. The sawhorse can be provided with the platform on both sides to provide additional cutting or material support surface which may then eliminate the need for a second sawhorse. Additionally the cutting support platform can be provided as a separate accessory that can be mounted to various manufactures' available sawhorses. An augmentation to the support platform would be to provide a platform with a telescoping extension as shown in FIG. 4.

1 Claim, 4 Drawing Sheets

(56) References Cited

U.S. PATENT DOCUMENTS

| | | | | | |
|---|---|---|---|---|---|
| 5,960,904 | A * | 10/1999 | Ullmann | 182/45 |
| 6,021,866 | A * | 2/2000 | Meeks | 182/153 |
| 6,155,318 | A * | 12/2000 | Underwood | 144/286.1 |
| 6,164,413 | A * | 12/2000 | Sagol | 182/153 |
| 6,269,905 | B1 * | 8/2001 | Smith | 182/45 |
| 6,286,824 | B1 * | 9/2001 | Sagol | 269/99 |
| 6,298,946 | B1 * | 10/2001 | Yemini et al. | 182/153 |
| 6,422,343 | B1 * | 7/2002 | Berg et al. | 182/153 |
| 6,488,119 | B1 * | 12/2002 | DuRapau et al. | 182/153 |
| 6,712,180 | B2 * | 3/2004 | Levy | 182/153 |
| 6,896,102 | B1 * | 5/2005 | Nichol | 182/186.5 |
| 8,016,079 | B1 * | 9/2011 | Huls | 182/181.1 |
| 2005/0230188 | A1 * | 10/2005 | Berg | 182/153 |

* cited by examiner

SAWHORSE WITH CUTTING SUPPORT PLATFORM

CROSS REFERENCE TO RELATED APPLICAT

Provisional patent No. 61/284,849, filing date: Dec. 28, 2009

STATEMENT REGARDING FEDERALLY SPONSORED RESEARCH or DEVELOPMENT

Not Applicable

REFERENCE TO SEQUENCE LISTING, ETC

Not Applicable

BACKGROUND OF INVENTION

This invention relates to sawhorses and there limitation of not providing adequate support primarily for material that is being cut. Existing sawhorses do not incorporate a means to provide this support and frequently requires a second person to provide this support or requires the person cutting the material to provide this support by some other means which frequently is to hold the material being cut-off with one hand while cutting with the other creating an unsafe condition. Without additional support, the material being cut will simply fall often causing the material to splinter on the end cut and/or become damaged on impact with the ground. Both rigid and non-rigid materials will benefit from the additional support or supports when applied to the both sides. The support platform will also provide support for the assembly of materials.

BRIEF SUMMARY OF THE INVENTION

It is a general object of the invention to overcome the above described limitations. The present invention is directed to a folding sawhorse having a folding support platform or platforms so as to provide support for rigid and non-rigid materials, primarily, but not limited to the support of material being cut-off. This is accomplished by utilizing a folding sawhorse consisting of fold up support platform, with or without extension, and mounted on one or both sides of the sawhorse. Additionally, when the cutting support platform is applied to both sides of the sawhorse, this creates a very portable cutting platform table.

DESCRIPTION OF THE PREFERRED EMBODIMENT

It will be readily understood that the components of the present invention, as generally described and illustrated in the figures herein, could be arranged and designed in a wide variety of different configurations. Thus, the following more detailed description of embodiments of the assembly and method of the present invention, as represented in FIGS. 1-4 is not intended to limit the scope of the invention but it is merely representative of the presently preferred embodiments of the invention.

Figure 1:
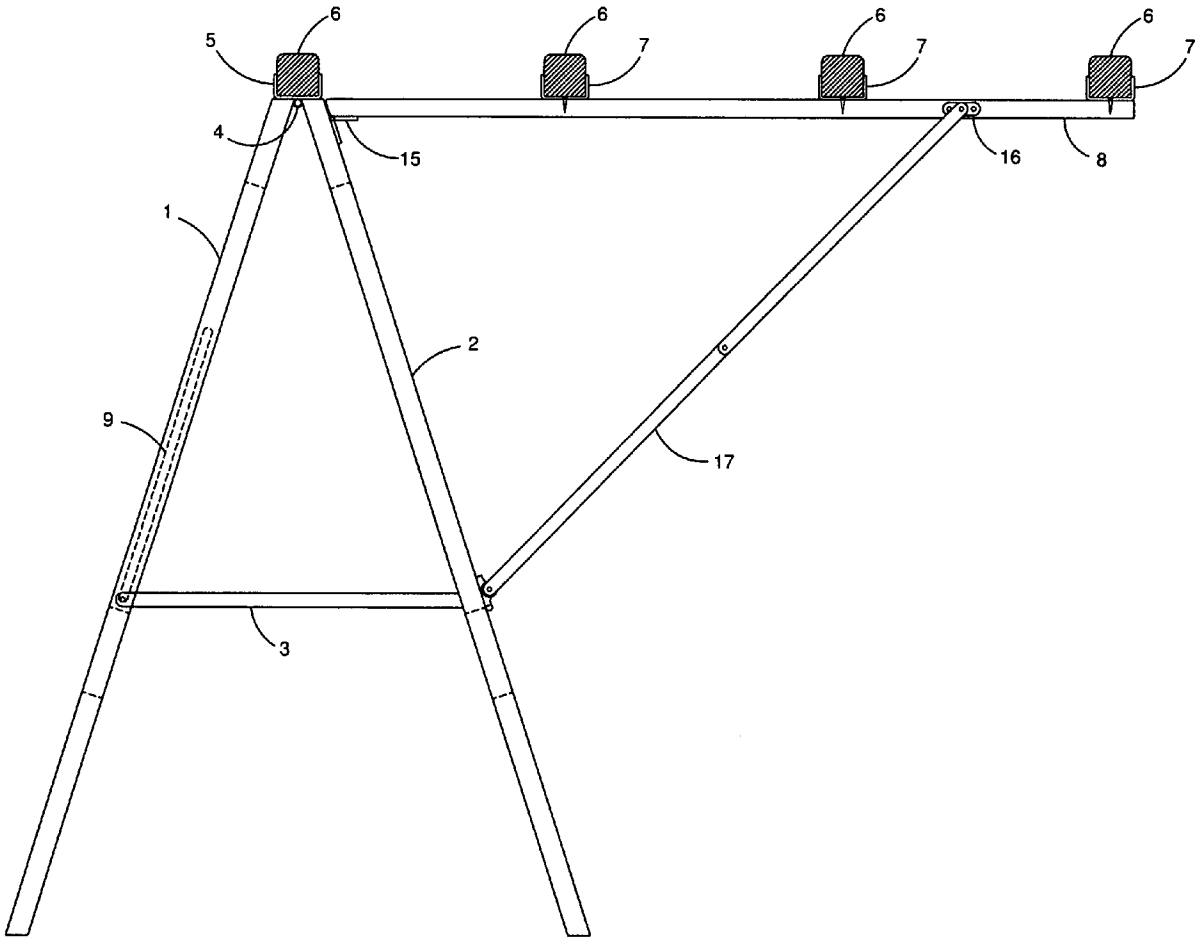
FIG. 1 is a side view showing the sawhorse with the support platform in the up or raised position.
Figure 2:
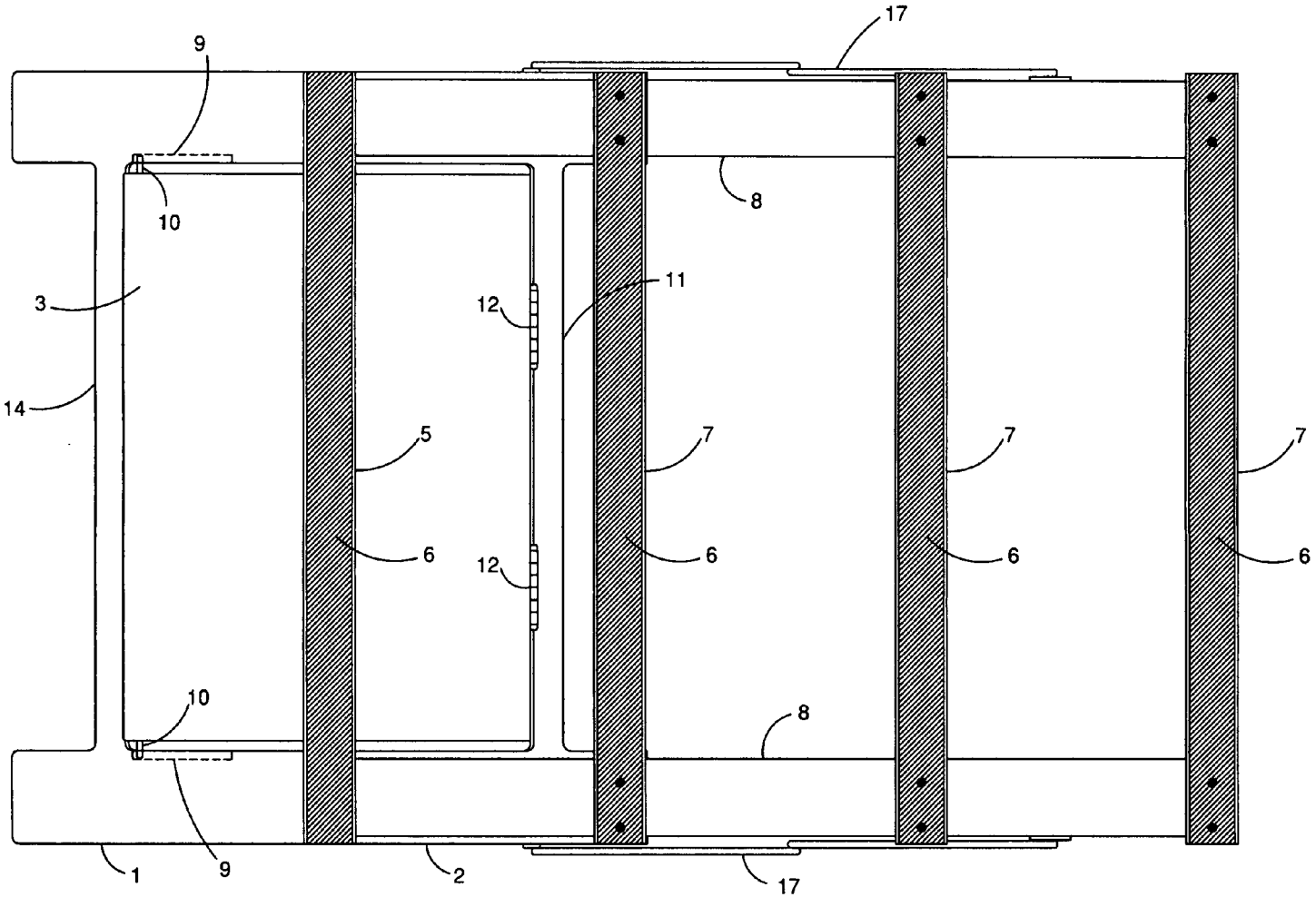
FIG. 2 is a top view showing the sawhorse with the support platform in the up or raised position.
Figure 3:
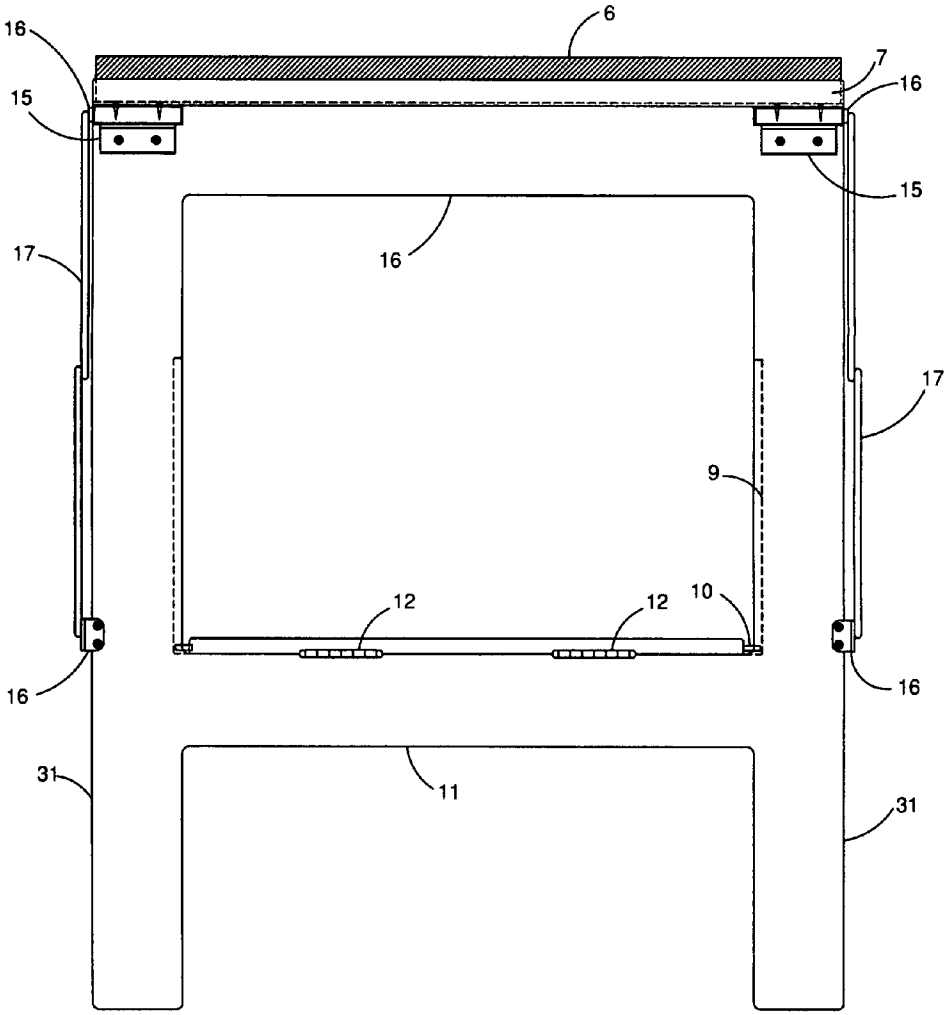
FIG. 3 is a front view, when viewed from the right side of FIG. 1, showing the sawhorse with the support platform up or raised.
Figure 4:
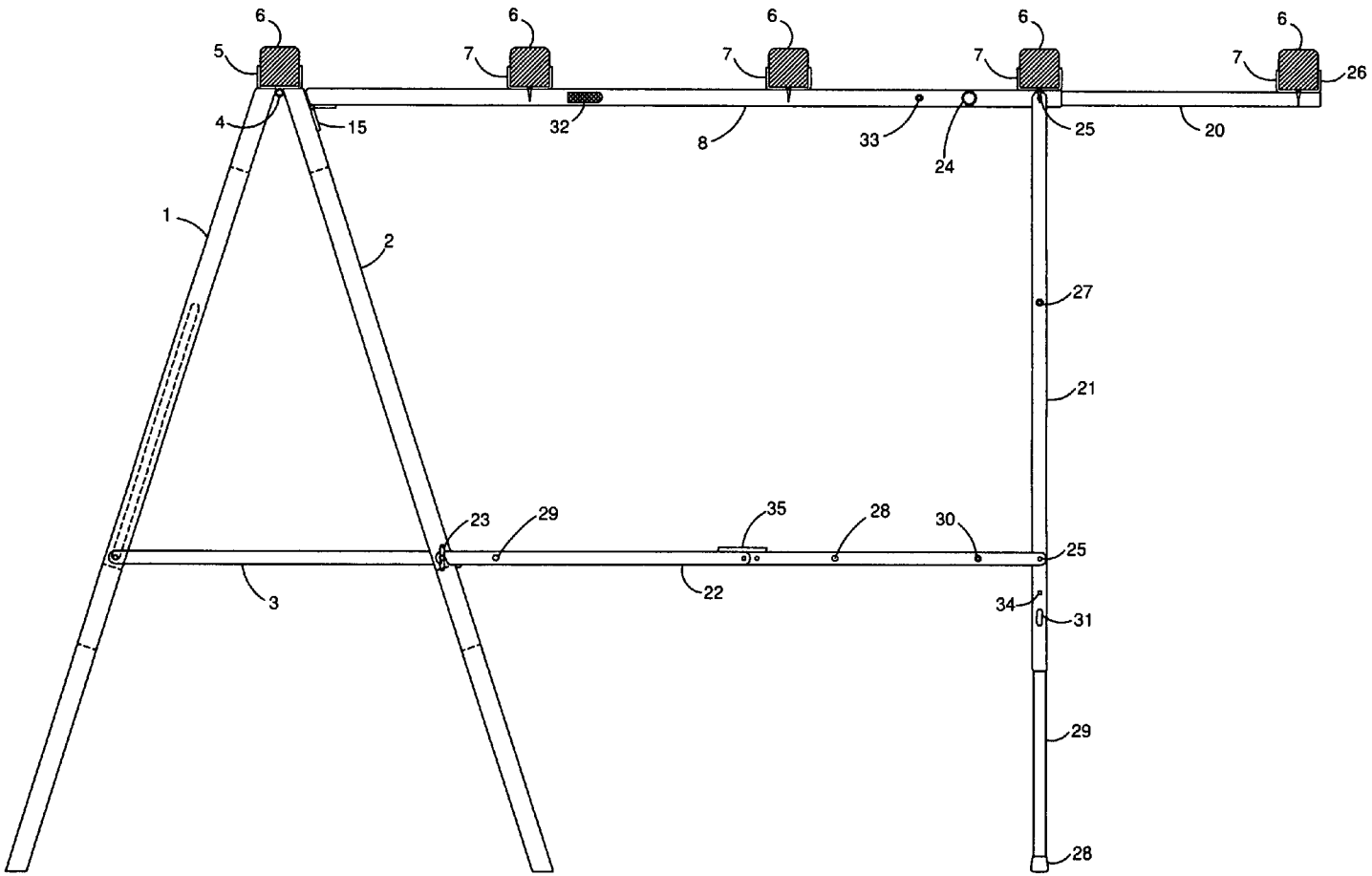
FIG. 4 is a side view showing a sawhorse with the support platform in the up or raised position with a telescoping extension and addition support leg.

A folding sawhorse with embodiments is illustrated in the figures herein and consists of a folding sawhorse with a cutting and material support platform as shown in FIG. 1-4. Referring specifically to FIG. 1-3, the folding sawhorse consists of an A-frame design comprised of two supporting frames 1 & 2 hinged together at the top with rod 4 running the length of the sawhorse and connecting frames 1 & 2. Rod 4 also captures the elongated tray 5 thru the elongated tray 5 bottom hinge loops thereby securing 1, 2, & 5 together in a hinged configuration thus creating a pivot point for the sawhorse to fold and unfold. The elongated tray 5 is designed to hold a material support riser 6 which the material being worked on or cut will rest on. Each frame 1 & 2 has a top horizontal brace member 16 and a lower parallel horizontal brace member 11, two vertical members 17, forming the legs, and spaced apart by and interconnected to top brace 16 and lower brace 11. A rectangular shelf 3 is connected by hinges 12 to brace 11 on frame 2. The opposite side of the shelf has pins 10 on each side. Frame 1 has opposing slots 9 providing a channel for the shelf pins 10 to slide up or down. Hinges 12 allow the shelf to pivot allowing the opposite side shelf pins 10 to slide within the slots 9. When the sawhorse is in the unfolded position, shelf 3 is supported by resting on brace 14. Support arms 8 are connected by hinge 15 to the sawhorse as shown in FIG. 1 and secured in place by screws 16. Hinge 15 allows the support platform to swing up or down as required. In the up or raised position, the support arms 8 are held in position by folding locking hinges 17 which are connected to the support arms in two locations as shown in FIG. 1. Folding hinges 17 allow the support arms to collapse into the down or lowered position for easy storage. Support arms 8 are connected by elongated trays 7 which are firmly fixed to the support arms 8 to form a rigid frame to support the material being cut or worked on. The elongated trays 7 are sized to hold the material support risers 6 via a resistance fit. Material support risers 6 provide a support surface for material being cut or worked on and provides elevation above support arms 8 to avoid damage to support arms 8 when cutting. The folding support platform hinges 15 are positioned on frame 2 so that all material supports 6 are on the same plane when the support platform is in the raised position. Support arms 8 are cross braced with elongated trays 7 which are horizontally mounted to the sawhorse and spaced to provide cutting paths. FIG. 4 shows an augmentation to the above described sawhorse with cutting support platform which includes the addition of a telescoping extension to provide additional material support. Adding this feature necessitates the need for adding support legs 19 for increased stability due to the potential effects created by the additional length of the support platform. The extension support arms 20 slide in and out of the support arms 8. Thumb screws 24 are used to hold the extension arms 20 in the open or closed position or any position in between. Legs 19 are connected to support arms 8 with shoulder type bolts 25 to allow the legs 19 and leg brace 21 to swing up toward the sawhorse or down in an open position as required. A locking folding brace 22 is hooked to and locked in place by thumb screw 23 when legs 19 are in the open position. Locking brace 22 can be folded and swung upward to a position along the side of the leg 19. Locking brace is held in place by nibs 27 & 30 which fit into indentations 28 & 29 respectively. Leg 19 can then be swung upward to a position along the side of the support arms 8 and are held in place by spring clip 32. Leg extension 29 slides in and out of leg 19 to provide for level positioning of the cutting surface platform on uneven ground. Leg extension 29 is held in place by thumb screw 31. Holes 34 & 33 provide a location for the internal spring pins to stop the extensions 29 and 20 from sliding all the way out. Pressing these spring pins inward also extension 29 and 20 to slide inward. Foot pad 28 is provided for protection of the bottom of extension 29.

I claim:

1. A sawhorse, comprising:

two supporting A-frames hinged together at their tops;

support arms providing a horizontal platform that folds and unfolds to one side of the two support frames; and a plurality of elongated trays, each elongated tray holding a respective support riser, each elongated tray with its respective riser spanning between and being situated along the support arms and the elongated trays with support risers spaced to establish cutting paths along the support arms, each elongated tray having a base affixed to the support arms and two sides that are perpendicular to the base and having a space between the two sides that holds that tray's support riser.

* * * * *